United States Patent [19]

Tsubata

[11] 4,254,803

[45] Mar. 10, 1981

[54] WOVEN STRINGER FOR SLIDE FASTENERS

[75] Inventor: Noritaka Tsubata, Uozu, Japan

[73] Assignee: Yoshida Kogyo K K, Tokyo, Japan

[21] Appl. No.: 58,688

[22] Filed: Jul. 18, 1979

[30] Foreign Application Priority Data

Jul. 28, 1978 [JP] Japan ..... 53-92993

[51] Int. Cl.[3] ..... A44B 19/10

[52] U.S. Cl. ..... 139/384 B; 24/205.16 C

[58] Field of Search ..... 139/384 B; 24/205.1 C, 24/205.13 C, 205.16 C, 205.16 R

[56] References Cited

U.S. PATENT DOCUMENTS

| | | | |
|---|---|---|---|
| 3,058,188 | 10/1962 | Yoshida | 24/205.16 C |
| 3,143,779 | 8/1964 | Hendley | 139/384 B |
| 3,454,052 | 7/1969 | Burbank | 24/205.16 C |
| 3,524,479 | 8/1970 | Burbank | 139/384 B |
| 4,011,895 | 3/1977 | Negro | 24/205.16 C |
| 4,188,982 | 2/1980 | Yoshida et al. | 139/384 B |
| 4,191,220 | 3/1980 | Yoshida | 24/205.16 C |
| 4,210,180 | 7/1980 | Tsubata | 24/205.16 C |

*Primary Examiner*—Henry Jaudon

*Attorney, Agent, or Firm*—Bucknam and Archer

[57] ABSTRACT

A woven fastener stringer for slide fasteners comprises a woven tape formed with foundation warp and weft threads and consisting of a web section defining a major dimension of the tape and a woven filament section defining a longitudinal edge portion of the tape, a row of successively interconnected elongated loops woven into the filament section, a plurality of covering warp threads overlying and underlying the loops, a stuffing cord extending longitudinally of the tape through the row of loops, at least one guide cord extending longitudinally of the tape in abutting engagement with the outer surfaces of heel portions of the loops, a binding weft thread continuing from the foundation and interwoven with the covering warp threads in the woven filament section, and a pair of tensioning warp threads extending longitudinally of the tape between the covering warp threads.

4 Claims, 12 Drawing Figures

WOVEN STRINGER FOR SLIDE FASTENERS

BACKGROUND OF THE INVENTION

1. Field of the Invention

This invention relates to a slide fastener, and more particularly to a fastener stringer having a continuous plastic filament spirally formed and woven into an edge of a stringer tape during the weaving thereof.

2. Prior Art

There have been proposed a number of slide fasteners or zippers of the type described, which comprise a woven stringer tape and a plastic filament woven into a longitudinal edge of the tape, the filament being usually formed into a helical coil structure consisting of a row of successive elongated loops or convolutions each having a coupling head, an upper leg and a lower leg and a connecting heel portion.

An advanced woven slide fastener of the type under contemplation was proposed in Japanese Patent Application No. 53-91 wherein a stuffing cord is inserted longitudinally through the coil of the filament and a guide cord or cords is disposed longitudinally of the filament in contact with the connecting heel portions of the coupling filament loops, the stuffing and guide cords being bound integrally with the coupling filament by the weave threads of the tape. While this earlier fastener product has advantages of its own, there is still much to be desired in respect of the positional stability of the fastener elements which would under the influence of external stresses become displaced longitudinally of the fastener. Furthermore, the warp threads covering the fastener elements would move out of place toward the connecting heel portions of the elements when the stringers are bent or twisted, with the results that the fastener elements are mismeshed or otherwise become inoperative.

SUMMARY OF THE INVENTION

The present invention is directed to improvements in and relating to a woven slide fastener of the type described, and has for its primary object to provide means of securing the filamentary fastener element stably onto an edge of a stringer tape against displacement during use of the fastener.

The securing means comprises a combination of weave threads disposed at the tape edge into which the filamentary fastener element is woven, said weave threads including a pair of tensioning threads extending longitudinally of the tape and urging a continuous binding weft into intimate contact with a plurality of covering warp threads from both above and below the successive filamentary loops.

The above and other objects and features of the invention will appear clear from the following detailed description of the invention taken in connection with the accompanying drawings which illustrate by way of example preferred embodiments.

BRIEF DESCRIPTION OF THE DRAWINGS

In the drawings like reference numerals or characters refer to like parts throughout the several views.

DETAILED DESCRIPTION OF THE PREFERRED EMBODIMENT

Figure 1:
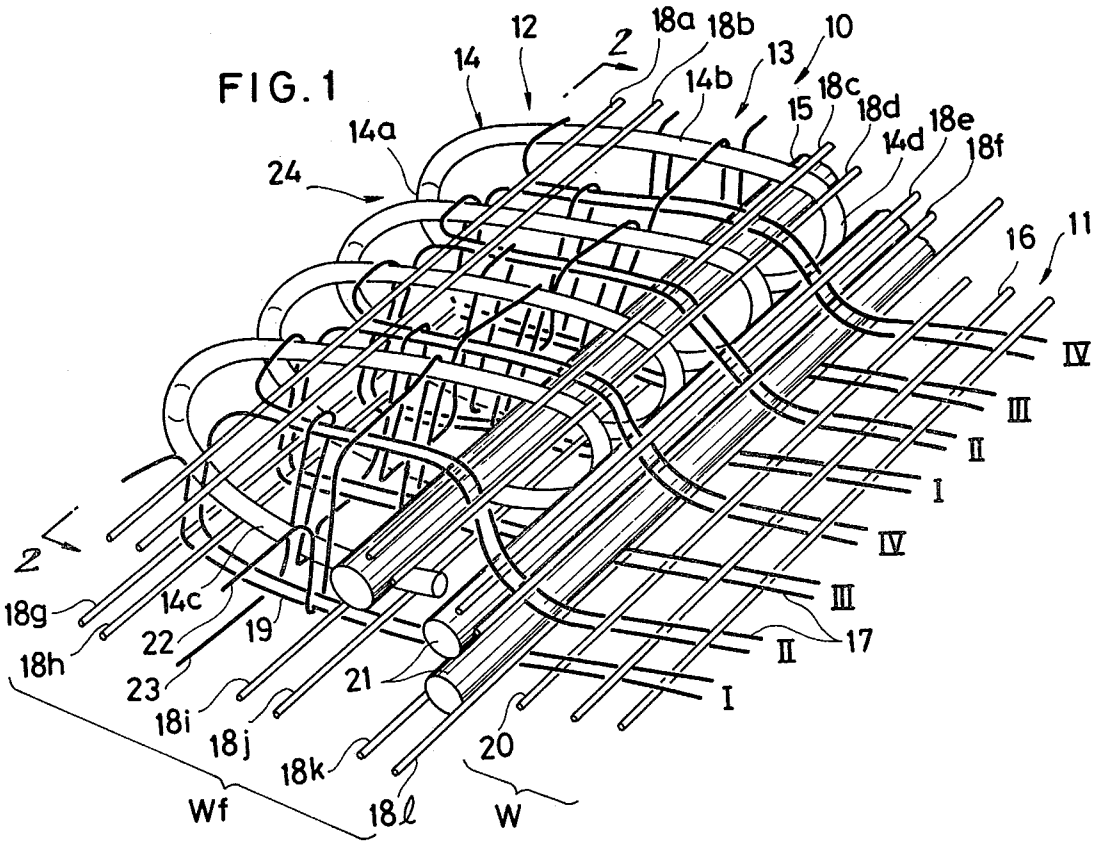
FIG. 1 is an enlarged fragmentary perspective view of a woven fastener stringer according to the invention.

Referring now to FIG. 1, there is shown a fastener stringer generally designated 10 which constitutes one part of a pair or two identical stringers for a slide fastener. The stringer 10 consists of a generally flat web section W defining a major dimension of a woven tape 11 and a woven filament section Wf defining a longitudinal edge portion or beaded edge 12 into which a filament 13 of a plastic material is woven. The filament 13 is formed from a linear blank of a suitable plastic material into a helically coiled structure having a succession of loops or elongated convolutions 14 during weaving of the tape 11.

Figure 2:
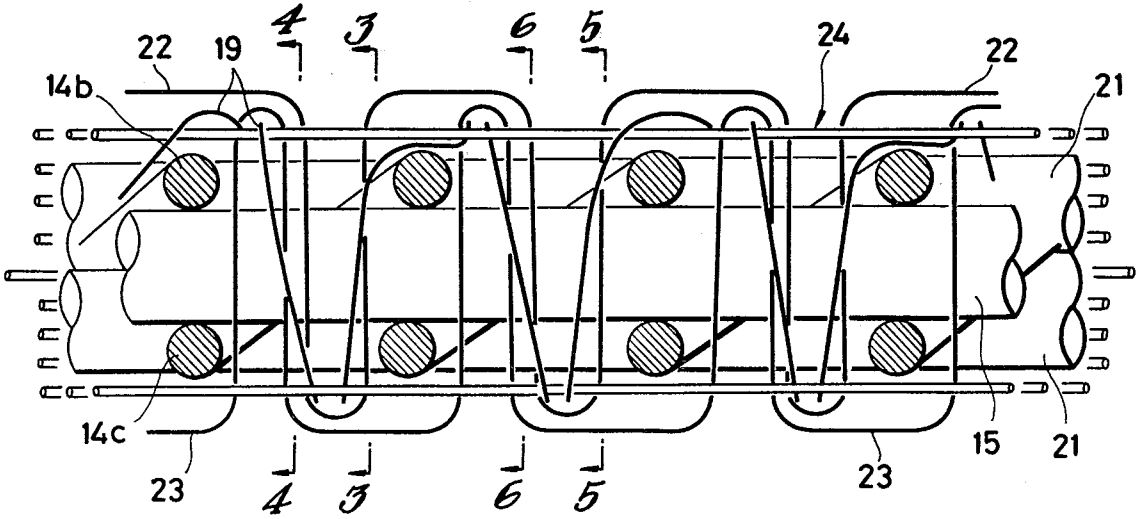
FIG. 2 is a longitudinal cross-sectional view taken on the line 2—2 of FIG. 1.

Each loop or elongated convolution 14 in the filament 13 has a coupling head **14*a* at one end thereof, an upper leg 14*b* and a lower leg 14*c* extending from the head 14*a* in a common direction and a heel portion 14*d* remote from the head 14*a* connected to a next adjacent one of the successive loops 14. The coupling head 14*a* is dimensioned to releasably couple with a corresponding head of a loop 14 on a mating stringer to open and close the fastener in the well known manner. The upper and lower legs 14*b* and 14*c* are spaced apart in substantially superimposed relation to each other as shown in FIG. 2 and define therebetween a longitudinally extending "tunnel" or hollow conduit through which a stuffing cord 15 is inserted closely along the interior walls of the heel portions 14*d***.

The web section W of the tape 11 may be of any known design having foundation warp threads 16 and foundation weft thread 17 which may be interwoven in a variety of known patterns.

The term "filament woven section Wf" is used to define a longitudinal edge portion of the tape 11 into which the filament 13 serving as a coupling element for a slide fastener is woven.

The row of coupling loops 14 is secured to the tape 11 at the filament woven section Wf by a plurality of covering warp threads 18, which extend in parallel with the foundation warp threads 16, and a binding weft thread 19 which is a continuous portion of the foundation weft thread 17.

There are provided for purposes of illustration a total of twelve covering warp threads 18, the first six ones designated **18*a* through 18*f* being disposed to overlie the upper leg portions 14***b* and the second six ones 18*g*–18*l* to underlie the lower leg portions 14*c* of the coupling filament loops 14.

Figure 3:
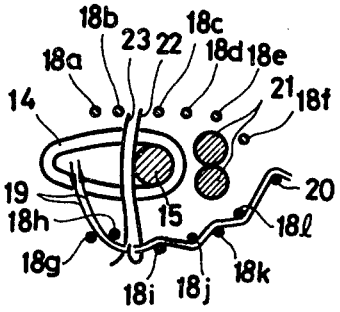
FIG. 3 is a sectional view taken on the line 3—3 of FIG. 2.
Figure 4:
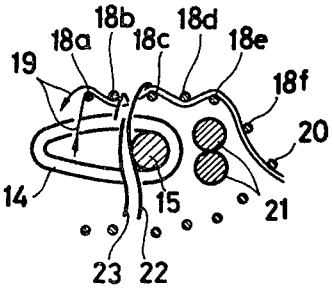
FIG. 4 is a sectional view taken on the line 4—4 of FIG. 2.
Figure 5:
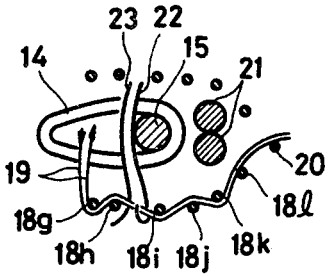
FIG. 5 is a sectional view taken on the line 5—5 of FIG. 2.
Figure 6:
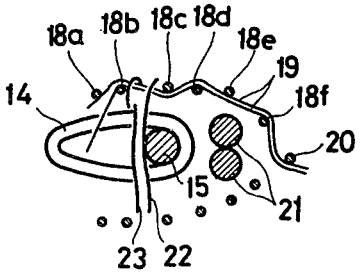
FIG. 6 is a sectional view taken on the line 6—6 of FIG. 2.
Figure 7:
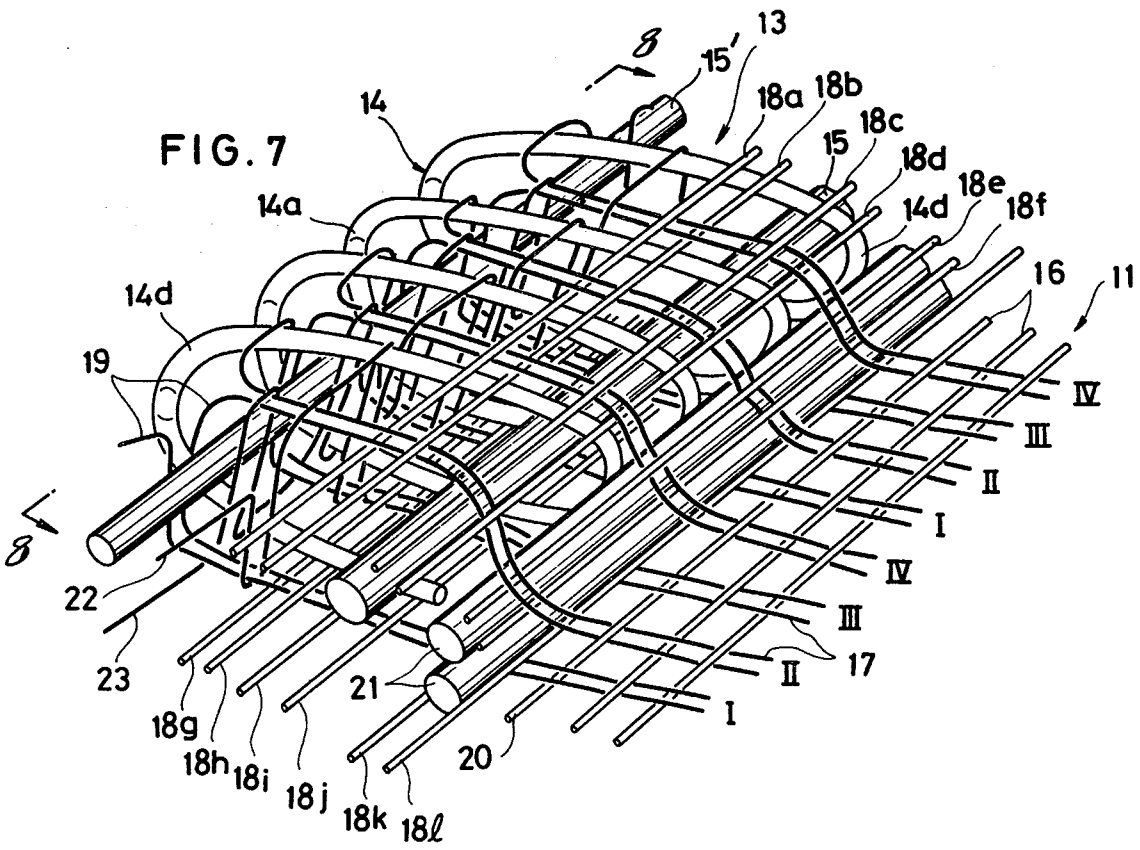
FIG. 7 is an enlarged fragmentary perspective view of another form of woven fastener stringer provided in accordance with the invention.
Figure 8:
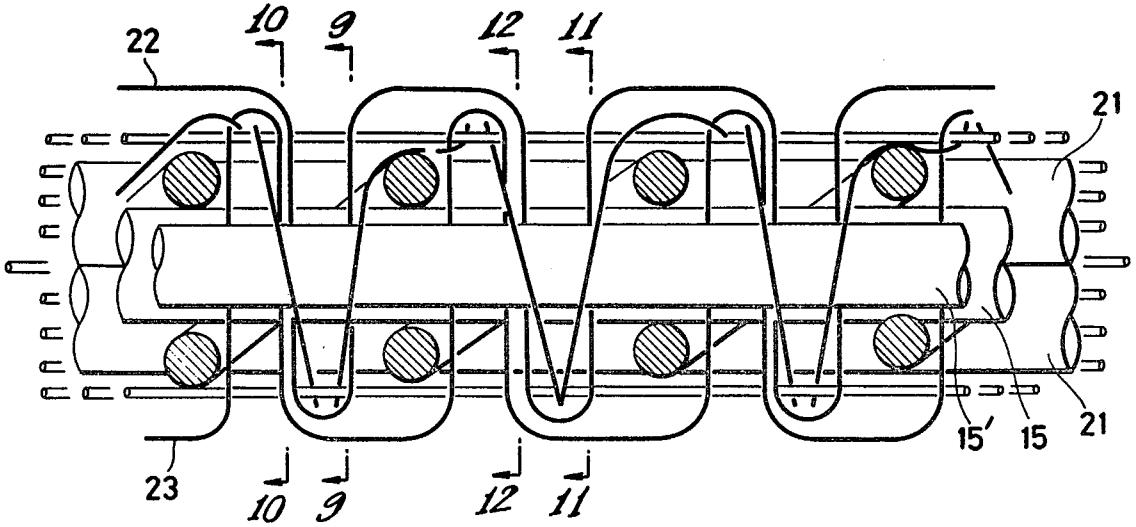
FIG. 8 is a longitudinal cross-sectional view taken on the line 8—8 of FIG. 7.
Figure 9:
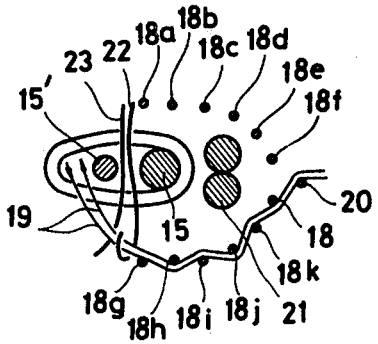
FIG. 9 is a sectional view taken on the line 9—9 of FIG. 8.
Figure 10:
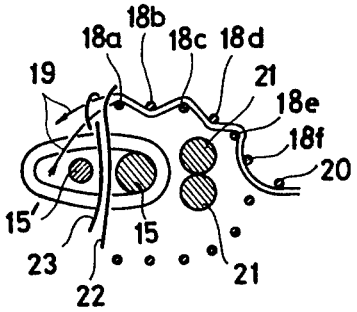
FIG. 10 is a sectional view taken on the line 10—10 of FIG. 8.
Figure 11:
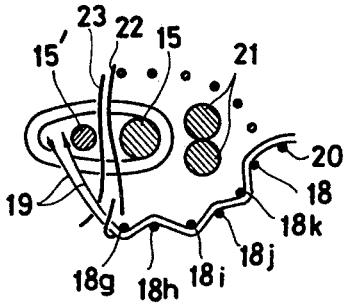
FIG. 11 is a sectional view taken on the line 11—11 of FIG. 8.
Figure 12:
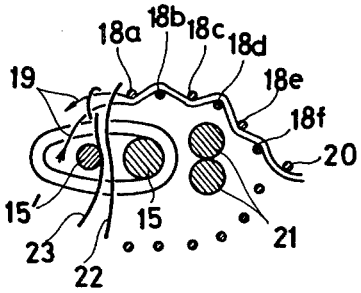
FIG. 12 is a sectional view taken on the line 12—12 of FIG. 8.

The binding weft thread 19, which is interwoven in a double pick with the covering threads 18, passes through the web section W into each pitch of adjacent loops 14. The first double pick I of the weft 19, as better shown in FIG. 3, passes over the covering warp thread 18*g*, then in under the covering warp thread 18*h*, alternately over one and under one of the covering warp threads 18*i*–18*l*, further over a terminal foundation warp thread 20. The second double pick II, as shown in FIG. 4, passes over the covering warp thread 18*a*, then in under the covering warp thread 8*h*, alternately over one and under one of the warp threads 18*c*–18*f*, further under the terminal warp thread 20. The third double pick III, as shown in FIG. 5, passes under the covering warp thread 18*g*, over the covering warp thread 18*h*, then alternately under one and over one of the warp threads 18*i*–18*l*, further over the terminal warp thread 20. The fourth and last double pick IV to complete one weaving cycle passes under the covering warp thread 18*a*, then over the covering warp thread 18*b*, alternately under and over the warp thread 18*c*–18*f*, further under the terminal warp thread 20, as shown in FIG. 6.

Designated at 21 are guide cords extending longitudinally of the tape 11 behind the heel portions 14*d* of successive loops 14. The guide cords 21, two of which are preferrably used in superposed relation as in the case illustrated, are bound in place against the external peripheral surfaces of the heel portions 14*d* by the covering warp threads 18*d*, 18*f*, 18*k* and 18*l* and double pick of the binding weft thread 19 as shown.

In accordance with the invention, there is provided a pair of tensioning warp threads 22 and 23 extending longitudinally of the tape 11 and interposed between and parallel with the covering warp threads 18. More specifically, in the embodiment shown in FIGS. 1 through 6, the tensioning warp threads 22 and 23 are interposed between the covering warp threads 18*b*(*h*) and 18*c*(*i*).

The first tensioning warp thread 22 passes over the upper leg 14*b* of the element 13, down through the space between two adjacent loops 14 or an inter-loop space 24 and around the binding weft thread 19 underlying the lower leg 14*c* and then up through the same inter-loop space 24 and over the next adjoining upper leg 14*b*.

The second tensioning warp thread 23 passes under the lower leg 14*c*, up through the inter-loop space 24 and around the binding weft thread 19 overlying the upper leg 14*b* and then down through the same inter-loop space 24 and under the next adjoining lower leg 14*c*.

The above cycle of run of the pair of tensioning warp threads 22,23 repeats itself at each pitch of successive loops 14 as better shown in FIG. 2. As the tensioning warp threads 22,23 pass around the binding weft thread 19, the latter thread 19 is held taut against the covering warp threads 18 from both above and below the successive loops 14 at each pitch thereof, so that each loops 14 of the element 13 is firmly anchored in place and maintained in its proper operative posture without otherwise tilting out of the correct coupling angle. With tension applied by the tensioning warp threads 22,23 to the covering warp threads 18 via the binding weft thread 19 in the woven filament section Wf, the covering warp threads 18 are held in intimate contact with the loops 14, and those warp threads 18*a*, 18*b* and 18*g*, 18*h* in particular lying adjacent the coupling heads 14*a* of the loops 14 are prevented by the tensioning warp threads 22,23 from moving off toward the heel portions 14*d*.

The embodiment shown in FIGS. 7 through 12 is the same in all respects to the first embodiment which has been above described, except that there is provided an additional stuffing cord 15′ extending through the coil of the elements 13 adjacent to the coupling heads 14*a* and substantially in parallel with the main stuffing cord 15 disposed at the heel portions 14*d* and that the binding weft thread 19 passes around the cord 15′ and that the tensioning warp threads 22,23 are interposed between the cord 15′ and the covering warp threads 18*a*, 18*g*.

The tensioning warp threads 22,23 are preferably made of such a plastic fiber which is more readily contractible with heat than the covering warp threads 18 or the weft thread 19 so that the threads 22,23 may impart higher tension to the woven filament section Wf of the tape 11 when the fastener is dyed or otherwise thermally treated.

Having thus described certain preferred embodiments of the invention, it will be understood that various changes and modifications may be made in the form and construction herein illustrated, without departing from the scope of the appended claims.

What is claimed is:

1. A woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section and interengageable with another row on a mating stringer, each of said loop having a coupling head at one end thereof, an upper leg and a lower leg extending from said head in a common direction, and a heel portion remote from said head connected to a next adjacent one of said successive loops; a plurality of covering warp threads overlying and under lying said loops; a stuffing cord extending longitudinally of the tape through said row of loops; at least one guide cord extending longitudinally of the tape in abutting engagement with the outer surfaces of said heel portions; a binding weft thread continuing from said foundation weft thread and interwoven with said covering warp threads in said woven filament section; and a pair of tensioning warp threads extending longitudinally of the tape between said covering warp threads, one of said tensioning warp threads passing over the upper leg of said loop, down through an inter-loop space and around the binding weft thread underlying the lower leg of said loop, and the other tensioning warp thread passing under the lower leg of said loop, up through an inter-loop space and around the binding weft thread overlying the upper leg of said loop.

2. A woven fastener stringer as claimed in claim 1, wherein said pair of tensioning warp threads pass around the binding weft thread in one and the same inter-loop space.

3. A woven fastener stringer as claimed in claim 1, including an additional cord extending in parallel with said stuffing cord adjacent the coupling heads of said loops, and wherein said pair of tensioning threads are interposed between said additional cord and said stuffing cord.

4. A woven fastener stringer as claimed in claim 1, wherein said pair of tensioning threads is made of a plastic fiber more readily contractible with heat than the remaining weave threads.

* * * * *